US005242069A

United States Patent [19]

Hertrampf

[11] Patent Number: 5,242,069

[45] Date of Patent: Sep. 7, 1993

[54] CLOSURE CAP FOR A BOTTLE OF LIKE CONTAINERS

[76] Inventor: Michael Hertrampf, Schafereiweg 7, D-3007 Gehrden 1, Fed. Rep. of Germany

[21] Appl. No.: 877,957

[22] Filed: Apr. 30, 1992

Related U.S. Application Data

[60] Division of Ser. No. 798,262, Nov. 18, 1991, abandoned, which is a continuation of Ser. No. 272,697, May 14, 1990, filed as PCT/EP88/00025, Jan. 15, 1988, publish as WO88/06130, Aug. 25, 1988, abandoned.

[30] Foreign Application Priority Data

Feb. 12, 1987 [DE] Fed. Rep. of Germany ... 8717026[U]

[51] Int. Cl.[5] ..... B65D 51/16

[52] U.S. Cl. ..... 215/260; 215/317; 215/270; 215/342; 220/208; 220/209

[58] Field of Search ..... 215/317, 260, 270, 315, 215/342, 350, 354

[56] References Cited

U.S. PATENT DOCUMENTS

| | | | |
|---|---|---|---|
| 190,612 | 5/1877 | Otterson | 215/342 |
| 574,379 | 1/1897 | Bouneu | 215/342 X |
| 914,252 | 3/1909 | Eschner | 215/342 X |
| 954,897 | 4/1910 | Steininger et al. | 215/342 |
| 958,513 | 5/1910 | Love | 215/342 |
| 1,466,314 | 8/1923 | Shelmon | 215/342 |
| 1,632,086 | 6/1927 | Lee | 215/342 X |
| 1,857,015 | 5/1932 | Gere | 215/260 |
| 1,869,938 | 8/1932 | Ingram | 215/260 |
| 1,978,946 | 10/1934 | Horner | 215/270 |
| 2,138,376 | 11/1938 | Griswold | 215/260 |
| 2,514,124 | 7/1950 | Eisen | 215/260 |
| 2,542,741 | 2/1951 | Weidner | 215/260 |
| 2,582,489 | 1/1952 | Krueger | 215/270 X |
| 2,732,089 | 1/1956 | Frydlender | 215/342 |
| 2,735,565 | 2/1956 | Wheaton et al. | 215/260 |
| 3,045,854 | 7/1962 | Patton | 215/260 |
| 3,051,342 | 8/1962 | Paniagua | 215/342 |
| 3,088,616 | 5/1963 | Freda | 215/342 |
| 3,114,467 | 12/1963 | Montgomery | 215/260 |
| 3,174,641 | 3/1965 | Kitterman | 215/260 |
| 3,239,091 | 3/1966 | Driscoll | 215/260 |
| 3,589,545 | 6/1971 | Carpenter et al. | 215/260 |
| 3,716,161 | 2/1973 | Julian et al. | 215/342 X |
| 4,165,816 | 8/1979 | Tupper | 220/203 |
| 4,799,598 | 1/1989 | McFadyen | 215/260 |
| 4,828,129 | 5/1989 | Jonkers | 215/260 |

FOREIGN PATENT DOCUMENTS

| | | | |
|---|---|---|---|
| 2501090 | 7/1975 | Fed. Rep. of Germany | 215/342 |
| 1058251 | 5/1954 | France | 215/342 |
| 434220 | 4/1948 | Italy | 215/342 |
| 469448 | 3/1952 | Italy | 215/342 |
| 1534570 | 12/1978 | United Kingdom | 215/260 |

*Primary Examiner*—Allan N. Shoap
*Assistant Examiner*—Vanessa Caretto
*Attorney, Agent, or Firm*—Allegretti & Witcoff, Ltd.

[57] ABSTRACT

A closure cap for a bottle having an external bead projecting from its neck. The cap is secured to the bead by an annular retaining part. A sealing disk is disposed beneath the cap-like retaining part, the periphery of which seals against the upper edge of the bottleneck i.e., the mouth of the bottle. An elastic member biases the sealing disk against the bottleneck. The sealing disk will lift off the bottle mouth to relieve any excess pressure generated by the contents of the bottle. A stop projecting from the retaining part defines the space between the cap and the neck to control the biasing force of the elastic member.

4 Claims, 1 Drawing Sheet

CLOSURE CAP FOR A BOTTLE OF LIKE CONTAINERS

This application is a divisional, of application Ser. No. 07/798,262, filed Nov. 18, 1991, which in turn is a continuation of Ser. No. 07/272,697 filed May 14, 1990, filed as PCT/EP88/00025, Jan. 15, 1988, publish as WO88/06130, Aug. 25, 1988, both now abandoned.

PRIOR ART

The invention relates to a closure cap for a bottle or like container.

Known closure caps for bottles are either screw-type closure caps or crown caps. Both types of closure caps essentially consist of a cap-shaped part which is secured by its shape to the bottleneck. Furthermore, a seal is provided between the closure cap and the bottleneck. Because of this secure connection, the bottle is pressure-resistantly closed. This includes the risk of the bottle being damaged in case of excess pressure. With bottles made of plastic as well as of glass this may lead to explosions and to leakage of the liquid which means a considerable risk in case the bottle contains hazardous contents. Moreover, in the case of glass bottles there is danger of personal injury, particularly of the eyes, by flying glass splinters.

Also known are cap-shaped plastic closure devices which are snapped onto the bottleneck. The same way the snap on, they may also snap off, thus releasing excess pressure, but the point at which they react to the excess pressure, is not defined, and furthermore, they do not automatically close after the excess pressure is released.

DE-OS 14 32 188 diskloses a closure cap of the type in question, having the form of a screw-type closure cap with a friction cork, the cork being separate from the screw-type closure cap and being connected by friction and by its shape to the screw-type closure cap. Thus, the friction cork is nothing other than a special type of sealing member which is securely connected to the screw-type closure cap. Consequently, this known screw-type closure cap does not differ from the screw-type closure cap first mentioned above, offering the same disadvantages, particularly the risk of explosion.

U.S. Pat. No. 2,950,833 diskloses a screw-type closure cap, the bottom of which consists of two halves of a disk which are movably hinged to a common diametrical axis. The flaps loosely abut upon the top edge of a threaded cylindrical part. A tight closure of the bottle cannot be achieved by this known screw-type closure cap, so that the problem of avoiding inadmissibly high excess pressure does not arise.

THE INVENTION

The object of the invention is to provide for bottles or like containers a closure cap of the type in question, which eliminates the risk of bottles exploding due to excess pressure.

The invention provides a closure cap in the form of a pop or relief valve which may be dimensioned so that no impermissibly high pressures may develop. Pressure from gas or liquid escaping from the bottle, is limited to the maximum permitted by the relief valve. Consequently, the bottle cannot explode thus preventing injuries to eyes, especially by glass splinters, in the case of glass bottles. With bottles made of plastic the risk is also high if the bottle contains a hazardous liquid. Since bottles filled with liquid, such as bottles containing carbonated beverages are usually stored and transported in an upright position, excess pressure escapes in the form of gas only. No liquid escapes. The advantage of avoiding excess pressure goes along with the completely negligible disadvantage of partially escaping carbon dioxide.

In one form of the invention, the retaining part is equipped with a stop for positively abutting the mouth of the bottleneck. As the disk-like sealing member also sits close to the mouth of the bottleneck, generally toward the inside, the relative positions of retaining part and sealing member are precisely defined. An elastic element for biasing the sealing member toward the neck is positioned between these two parts, and thus the extent of the biasing force of the elastic element also is exactly defined. The biasing force thus controls the pressure at which the sealing member lifts off, i.e., the relief valve opens.

The elastic element may consist of a flexible bar mounted at its ends in the retaining part and bearing on the sealing member in the central area on the side opposite the sealing side. This bar may be made of metal, particularly of steel, thus keeping its elastic properties over a long period of time and consequently the opening pressure of the relief valve remains constant over a long period of time.

The elastic element may consist of the sealing member itself being made from an elastic material or from a thin flexible material. The elastic flexibility may also be provided only partially, e.g., near the margin of the element.

The retaining part and sealing member may be tightly connected through the elastic element. This connection may also be separable, e.g., have the form of a snap connection.

The sealing member may also take the form of a rigid disk or a foam disk or of a disk having several springy lips. Particularly in the latter cases it is advisable to provide the retaining part with an interior radial protrusion, such as a circular collar, which grips the sealing member from the sealing side and which retains the sealing member in the interior of the cap-shaped retaining part. This structure also permits biasing the elastic element.

All parts of the closure cap may be made of plastic or metal, depending on the requirements and on the possible re-use. The connection between retaining part and bottleneck may also be of any type. It may be a frictional closure, or one shaped to hold by its configuration, e.g., a crown cap or screw-type closure cap.

THE DRAWINGS

The invention will be explained in more detail by different embodiments shown in the drawings in which FIG. 1 is a vertical sectional view of a first embodiment of the closure cap in accordance with the invention on a bottleneck.

In all the Figures the embodiments are illustrated the same way, and identical or corresponding parts are designated with the same reference numbers.

DETAILED DESCRIPTION

Figure 1:
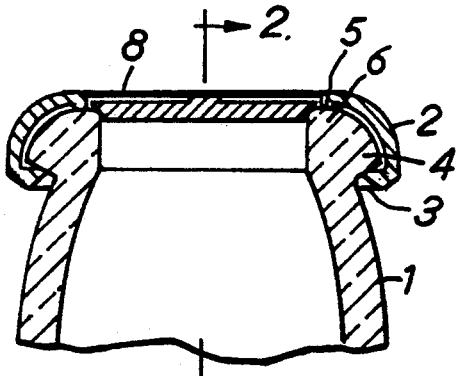
Figure 2:
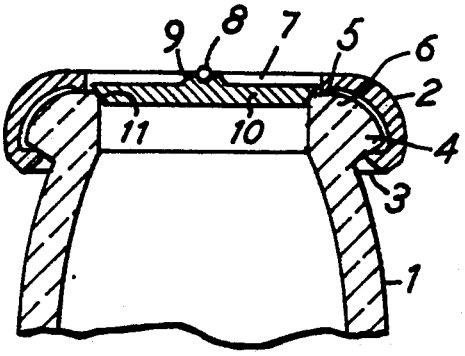
FIG. 2 is a cross-sectional view taken along the line II—II of FIG. 1.

FIGS. 1 and 2 represent two vertical cross-sections in a perpendicular position to each other, showing an embodiment with the upper part of a bottleneck 1 on which is positioned a cap-shaped fixed ring-like retaining part 2 having a radial interior collar 3 which grips from beneath an upper bead 4 of the bottleneck 1 to hold the retaining part on the bottle. In this position, the stop or seal 5 on the retaining part 2 bears against the upper edge 6 of the bottleneck 1, so that its position is exactly defined.

In the construction shown in FIGS. 1 and 2, a round opening 7 is formed in the bottom area of the cap-shaped retaining part 2. A round bar 8 is formed in one piece with the retaining part 2 by integrally molding from plastic. The central part of the bar 8 is removably gripped from beneath by a bracket having a pair of lips 9 integral with sealing member 10. Sealing member 10 takes the form of a rigid disk having an annular conical sealing surface 11 which tightly abuts upon the inner edge of the mouth 6 of the bottleneck 1. This conical sealing surface may be coated by a soft sealing material.

The relative positions of annular stop 5, sealing member 10 and bar 8 are such that in the illustrated closed position the bar 8 is under a biasing force in relation to the surface of the sealing member 10. The biasing force determines the pressure at which the sealing member 10 lifts off the mouth of the bottle due to the internal pneumatic or hydraulic pressure, and excess pressure is released.

Figure 3:
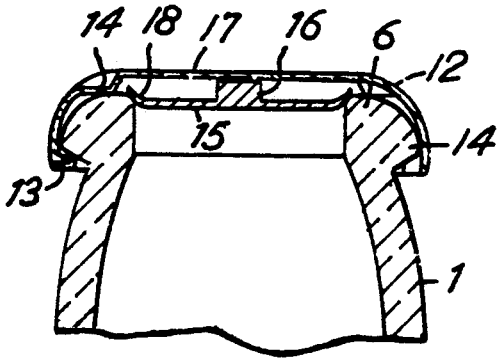
FIG. 3 is a view like FIG. 1 showing a second embodiment with a crown cap.

In the second embodiment shown in FIG. 3 the retaining part is shaped like a crown cap 12 which is clamped by crown-like projections 13 around the protrusion or bead 4 of the bottleneck 1. The cap has an annular depression or stop 14 bearing against the upper edge or lip 6 of the bottleneck 1 which fixes the position of the cap with respect to the bottleneck. In this position, the crown cap 12 is spaced upwardly from the edge 6 of the bottleneck 1.

In this embodiment, the aperture of the bottleneck is sealed by a disk 15 constituting the sealing member. This disk is tightly connected in the center through a support 16 with a bottom 17 of the crown cap 12. At its periphery the disk 15 has a circular sealing lip 18 which touches the upper edge 6 of the bottleneck 1. Disk 15 and sealing lip 18 are made of an elastic flexible material and are so thin that the periphery of the disk 15 and the circular sealing lip 18 will lift off to release excess pressure. The crown cap 12 may be made conventionally of tin, while the disk 15 with the circular sealing lip 18 is made of plastic. The disk may also be made of a different material such as tin.

Figure 4:
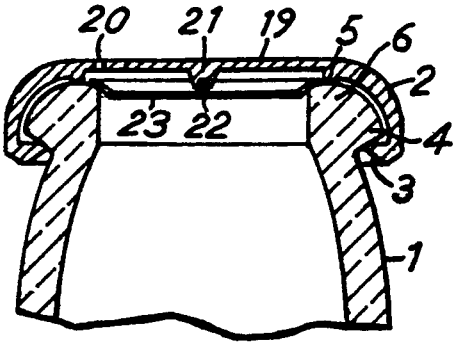
FIG. 4 is a view like FIG. 1 showing a third embodiment.

In the third embodiment shown in FIG. 4, the cap is like the embodiment shown in FIG. 2, except that a bottom 19 of the retaining part 2 is similar to the bottom 17 of the embodiment shown in FIG. 3. In order to make sure excess pressure will be released through the retaining part 2, a hole 20 is provided in the bottom 19.

A support 21 projects from bottom 19 which, via a spherical snap connection 22, is connected with a disk 23 which is identical with the disk 15 of FIG. 3 and which is made of a flexible material, so that, in case of excess pressure, particularly the edges of disk 23 may lift off from the edge 6 of the bottleneck 1. With this embodiment, it is also possible to make the bottom 19 very thin and elastically flexible, so that the latter is a spring element, in which case the disk 23 may be rigid. Bottom 19 and disk 23 may be as elastically flexible as desired.

Figure 5:
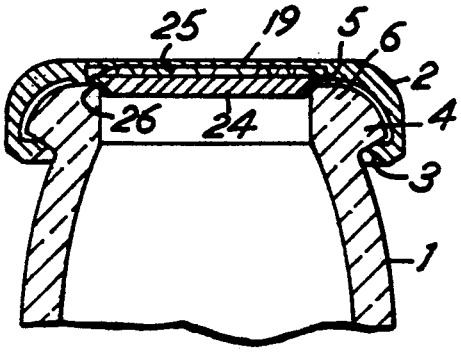
FIG. 5 is a view like FIG. 1 showing a fourth embodiment.

In the fourth embodiment shown in FIG. 5, the fixed part 2 is substantially identical with the embodiment of FIG. 4, except that a rigid disk-like sealing member 24 is provided which is elastically supported by spring lips 25 which bear against the bottom 19. In this embodiment, a circular collar 26 extends inwardly from the stop 5, and grips from beneath the periphery of the sealing member 24, so that the closure member 24 is undetachably connected to retaining part 2.

Figure 6:
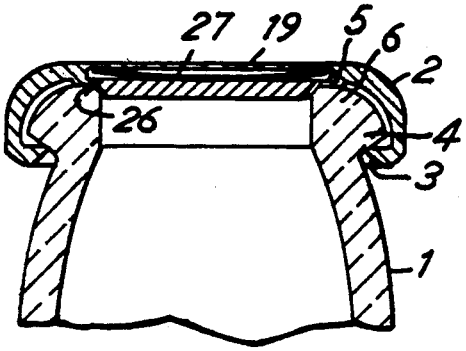
FIG. 6 is a view like FIG. 1 showing a fifth embodiment.

The fifth embodiment shown in FIG. 6 essentially corresponds to the embodiment of FIG. 5, except that instead of the spring lips 25 a spring bar 27 is in form of a pre-bent leaf spring is provided in the space between the bottom 19 and the sealing member 24. By dimensioning and curving the spring bar 27, the elastic force is controlled. This force determines the excess pressure at which the sealing member lifts off in order to release the excess internal pressure.

Figure 7:
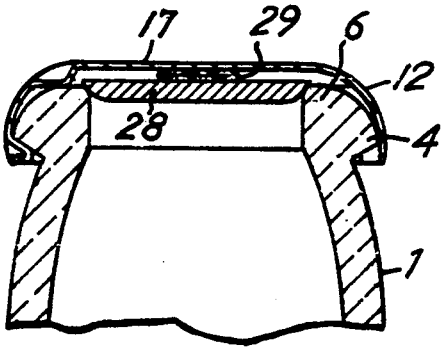
FIG. 7 is a view like FIG. 1 showing a sixth embodiment.

The sixth embodiment shown in FIG. 7 substantially corresponds to the embodiment of FIG. 3, except that instead of the flexible disk 15, a substantially rigid sealing member 28 is provided which is supported at the bottom 17 of the crown cap 12 through an elastically flexible foam part 29. The foam part 29 may be glued to the adjacent surfaces, so that the sealing member 28 is securely connected to the bottom 17, and thus to the crown cap.

What I claim is:

1. A closure and a bottle, said bottle having a neck forming an opening and terminating in an outer lip, said lip having an axially facing surface facing said closure, said closure comprising:

a cap-shaped retaining part which fits over said neck and covers said opening, a sealing disk, separate from said retaining part, disposed between said opening and said retaining part, said disk being elastic at its periphery and engaging said neck, to exert a biasing force on said neck, said periphery being free to flex due to pressure in the bottle, to release the pressure, and support means between said disk and said retaining part, the improvement comprising:

an annular stop projecting from said retaining part which abuts said axially facing surface of said lip to define the position of said retaining part in relation to said lip such that said periphery is spaced from said retaining part for allowing said periphery to flex.

2. The closure of claim 1 in which said stop is integrally formed with said retaining part.

3. The closure of claim 1 in which said retaining part, and said disk are made of plastic material.

4. The closure of claim 1 in which said support means is secured to said disk and to said retaining part.

* * * * *